United States Patent [19]

Donnelly et al.

[11] 3,935,424

[45] Jan. 27, 1976

[54] FLASH FUSING APPARATUS

[75] Inventors: Thomas L. Donnelly; Edward J. Mullen, both of Webster, N.Y.

[73] Assignee: Xerox Corporation, Stamford, Conn.

[22] Filed: Oct. 18, 1974

[21] Appl. No.: 516,042

[52] U.S. Cl. ..... 219/216; 219/388; 250/319

[51] Int. Cl.[2] ..... H05B 1/00; G03G 15/00

[58] Field of Search ..... 219/216, 388; 250/317–319; 432/59–60, 227–228; 355/9

[56] References Cited

UNITED STATES PATENTS

| | | | |
|---|---|---|---|
| 2,807,703 | 9/1957 | Roshon, Jr. | 219/216 UX |
| 3,436,523 | 4/1969 | Umahashi et al. | 219/216 |
| 3,445,626 | 5/1969 | Michaels | 219/388 X |
| 3,464,680 | 9/1969 | Nakamura et al. | 219/216 X |

*Primary Examiner*—C. L. Albritton

[57] ABSTRACT

A flash fusing apparatus for fusing toner images onto flexible support material in which the support material is transported in a cylindrical path encircling the flash fusing lamp which is positioned along longitudinal axis of the path. The cylindrical path is defined a cylindrical member encircling the flash fusing lamp. One or more disc members positioned along the cylindrical path are used to advance the support material along its path with the toner images facing inwardly toward the lamp to receive uniform radiation upon pulsing of the lamp which is activated by a sensing device.

4 Claims, 2 Drawing Figures

FLASH FUSING APPARATUS

Figure 1:
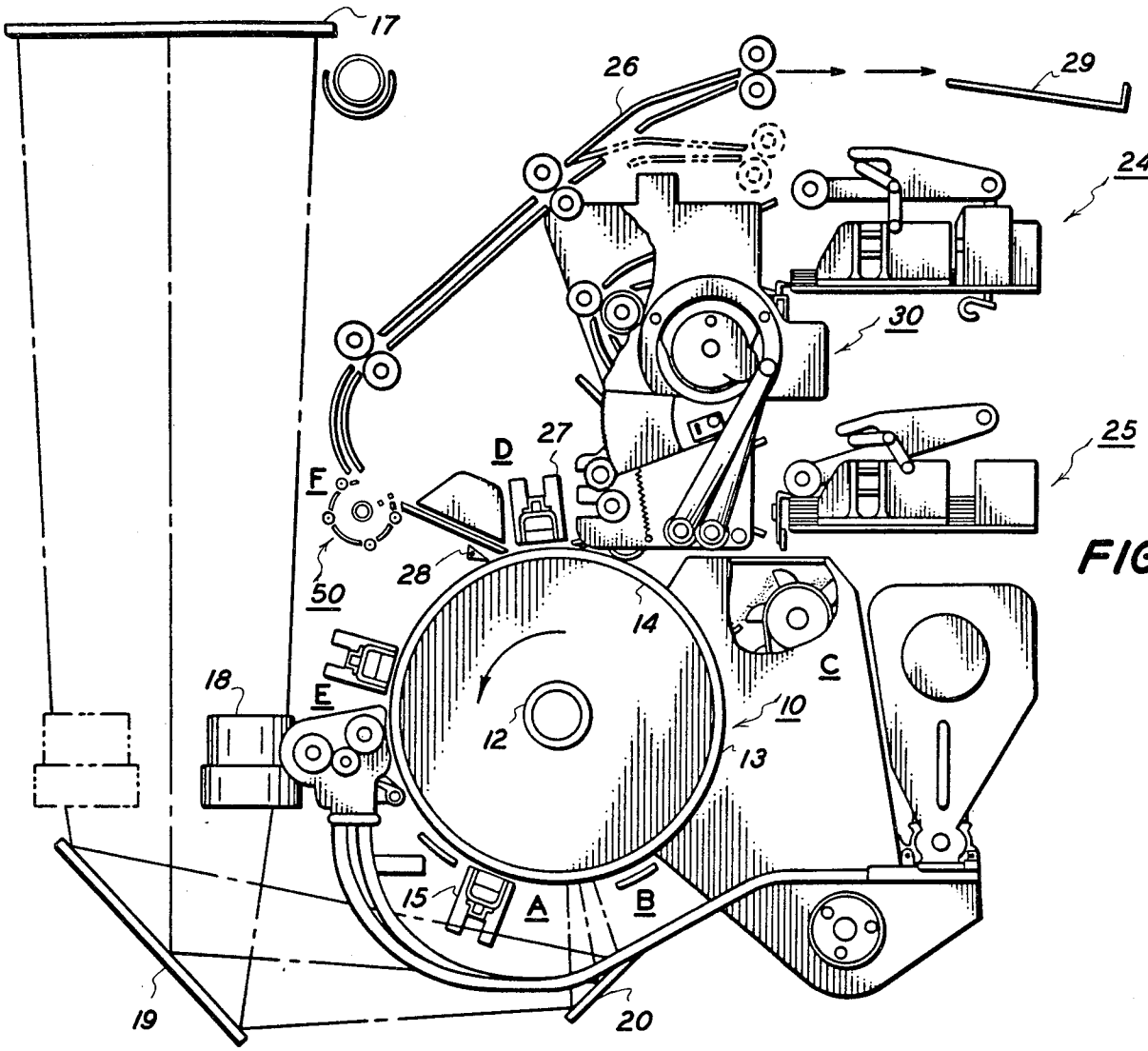

This invention relates generally to flash fusing and in particular to methods and apparatus for fusing toner images onto flexible support materials. More specifically this invention relates to a xerographic flash fusing apparatus and methods for rapidly and efficiently producing uniform image fixing on a flat support material.

In the xerographic process, a plate, generally comprising a conductive backing upon which is placed a photoconductive insulating surface, is uniformly charged and the photoconductive surface then exposed to a light image of an original to be reproduced. The photoconductive surface is caused to become conductive under the influence of the light image so as to selectively dissipate the electrostatic charge found thereon to produce what is developed by means of a variety of pigmented resin materials specifically made for this purpose which are known in the xerographic art as "toners". The toner material is electrostatically attracted to the latent image areas on the plate in proportion to the charge concentration found thereon. Areas of high charge concentration become areas of high toner density while correspondingly low charge image areas become proportionally less dense. The developed image is transferred to a final support material, typically paper, and fixed thereto to form a permanent record or copy of the original.

Many forms of image fixing techniques are known in the prior art, the most prevalent of which are vapor fixing, heat fixing, pressure fixing or a combination thereof as described in U.S. Pat. No. 3,539,161. Each of these techniques, by itself or in combination suffer from deficiencies which make their use impractical or difficult specific xerographic applications. In general, it has been difficult to construct an entirely satisfactory heat fuser having a short warm up time, high efficiency, and ease of control. A further problem associated with heat fusers has been their tendency to burn or scorch the support material. Pressure fixing methods, whether hot or cold have created problems with image off-setting, resolution degradation and producing consistently a good class of fix. On the other hand, vapor fixing, which typically employs a toxic solvent has proven commercially unfeasible because of the health hazard involved. Equipment to sufficiently isolate the fuser from the surrounding ambient air must by its very nature be complex and costly.

With the advent of new materials and new xerographic processing techniques, it is now feasible to construct automatic xerographic reproducing apparatus capable of producing copies at an extremely rapid rate. Radiant flash fusing is one practical method of image fixing that will lend itself readily to use in a high speed automatic process as described in U.S. Pat. No. 3,529,129. The main advantage of the flash fuser over the other known methods is that the energy, which is propagated in the form of electromagnetic waves, is instantaneously available and requires no intervening medium for its propagation. As can be seen, such apparatus does not require long warm up periods nor does the energy have to be transferred through a relatively slow conductive or convective heat transfer mechanism.

Although an extremely rapid transfer of energy between the source and the receiving body is afforded by the flash fusing process, a major problem with flash fusing as applied to the xerographic fixing art, has been designing apparatus which can fully and efficiently utilize a preponderance of the radiant energy emitted by the source during the relatively short flash period. The toner image typically constitutes a relatively small percentage of the total area of the copy receiving the radiant energy. Because of the properties of most copy materials, as for example, paper most of the energy incident thereon is wasted by being transmitted through the copy or by being reflected away from the fusing area. Another disadvantage associated with the prior art flash fusing apparatus has heretofore been the non-uniformity of image fixing produced. This phenomena is primarily due to the fact that it is difficult to produce high uniform irradiance on a large receiving surface as for example a sheet of paper, from a relatively small source such as a flash lamp.

While considerable effort has been expended in providing schemes for enhancing the efficiency and uniformity of fix of electrographic flash fusing systems, most efforts have been directed toward the provision of specially contoured reflecting surfaces which are designed to at least partially surround the flash lamp and thereby conserve energy via multiple reflections as set forth in U.S. Pat. No. 3,529,129. In addition to being costly to fabricate, such reflecting surfaces tend to become contaminated by loose toner particles and thereby necessitate frequent cleaning operations.

It is therefore an object of this invention to improve flash fusing of xerographic toner images.

Another object of the invention is to accomplish fusing of electrostatic images with a single flash.

Another object of the invention is to enable highly efficient fusing of toner images onto flexible support material.

Figure 2:
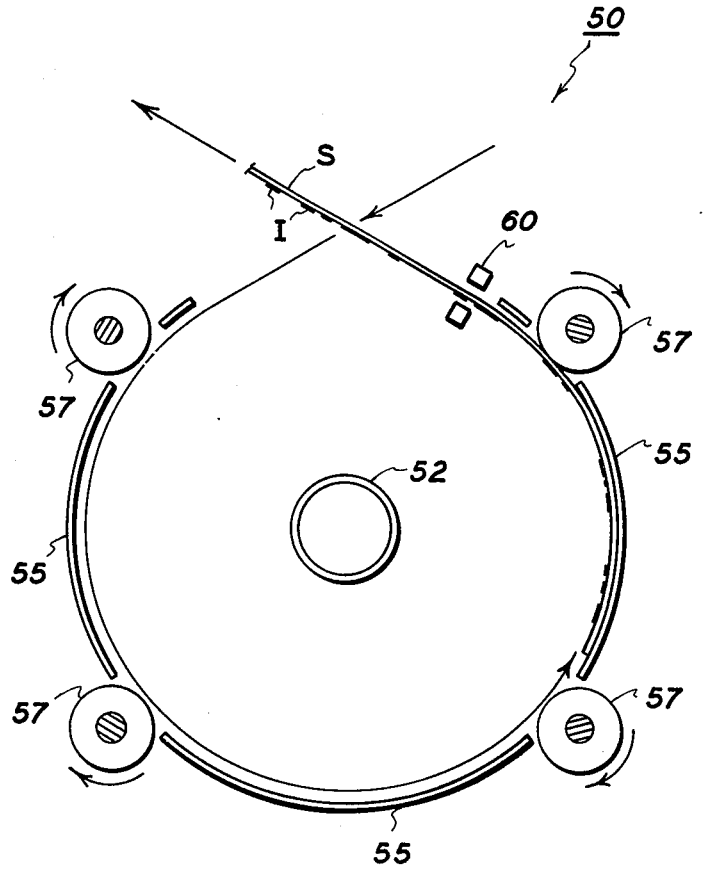

For a better understanding of the invention as well as other objects and further features thereof, reference is had to the following description of the invention to be read in conjunction with the drawings wherein:

FIG. 1 is a schematic diagram illustrating xerographic apparatus embodying the fusing apparatus of the invention; and FIG. 2 is a detailed side view of the preferred embodiment of the flash fusing apparatus of the invention.

Referring now to FIG. 1, there is illustrated a schematic representation of an automatic xerographic reproducing machine employing the flash fusing apparatus of the present invention. It should be noted that while the apparatus of the present invention will be explained in conjunction with the reusable xerographic process; however, it should be clear to one skilled in the art that the apparatus of the present invention is not so limited and that the invention has wider application in any environment where it is desirous or necessary to permanently fix resinous toner particles onto a flexible support material.

Because the xerographic copying process is well known and used in the art, the processing steps herein employed will only be briefly described in reference to FIG. 1. Basically, the heart of the machine involves a photosensitive plate 10 which is formed in a drum configuration. The drum is mounted upon a horizontally aligned support shaft 12 and caused to rotate in direction indicated so that the photosensitive plate passes sequentially through a series of processing stations. The drum shaped plate basically consists of an outer layer 13 of photoconductive material, such as selenium or the like that is placed over a grounded substrate 14.

In operation, the plate is initially charged to a uniform potential at a charging station A by means of a corona generator 15. The uniformly charged plate surface is then moved into an imaging station B wherein a flowing light image of the original document, which is supported upon a viewing platen 17 is projected onto the photoconductive plate surface by means of a moving scanning lens element 18 and a pair of mirrors 19 and 20. As a result of the imaging process a latent electrostatic image containing the original subject matter is recorded on the photoconductive plate surface.

The latent image is next transported on the drum through a developing station C wherein the latent image is rendered visible by the application of specially prepared charged toner particles which are cascaded over the image plate surface. The now visible toner image is then transported into the next subsequent processing station, an image transfer station D, wherein a sheet of final support material is fed from either one of two supply tray areas, an upper supply tray 24 and a lower supply tray 25, via a sheet registering and forwarding mechanism 30 in synchronous moving contact with the visible image carried on the plate surface. The support sheet and the charged toner image on the drum surface are moved together under a transfer corona generator 27 which serves to electrostatically transfer the toner images in image configuration from the drum surface onto the contacting side of the support sheet. The imaged sheet is then stripped from the drum surface by means of a pick off finger 28 and directed along a stationary vacuum transport 29 towards fusing station F where the flash fusing apparatus of the invention generally designated 50 for high efficiency rapid fusing of the toner image onto the support sheet as will be explained more fully hereinafter.

As noted above, the automatic copying device has the capability of producing either single sided copy, that is, copy bearing a toner image on one side thereof or double sided copy. In a single sided mode of operation, the final support sheets are fed from either one of the two supply trays directly into the image transfer station via the sheet forwarding and registering mechanism 30. Upon the accomplishment of the transfer step, the image sheet is passed through and forwarded directly into a copy tray 29 where the copies are stored and held until such time as the machine operator removes them. On the other hand, when a two sided copying mode of operation is selected, movable transport 26 within the circular paper path, is lowered to the dotted line position as shown in FIG. 1 and the upper supply tray, which has previously been emptied of all support material is automatically prepared to accept a copy sheet directed therein. The copy sheets are then fed from the lower support tray to the image transfer station and the image fusing station directly into the upper support tray area where the sheets are stored until the machine is further programmed for a second run. Upon the initialization of the second copy run, the movable transport 26 is once again raised to solid line position as shown in FIG. 1 and the once imaged copy sheets are fed again directly from the upper supply tray through the transfer and fusing stations wherein a second image is created on the opposite or previously non-image side of the sheet. After fusing, the two sided copy sheets are fed directly into a copy tray in the manner herein described above.

It is believed that the foregoing description is sufficient for purposes of the present application to show the general operation of a xerographic reproducing machine. For a more detailed explanation of the components, reference is made to U.S. Pat. No. 3,645,615 entitled Copying Apparatus.

Referring now to FIG. 2 in accordance with the present invention, loose toner particles carried on flexible support sheet S are fused thereto by cylindrically curling the support sheet about the axis of an elongated source of radiant energy in the form of a flash lamp 52. The support sheet S which is made out of a sheet of copy paper is transported along a circular path formed by cylindrically curved elements 55 by means of continuously moving disc members 57 which are rotated in a direction indicated by the arrows and which are positioned on the periphery of the cylindrically formed support sheet path. Desirably, the length of the path around flash lamp 52 is approximately equal to the length of sheet S. It will be appreciated that sheets of copy paper are moved along a circular path such that the toner bearing surface of the support sheet is untouched and continuously faces toward the center of curvature of the path where flash fusing lamp 52 is situated. It will be further appreciated that flash fusing apparatus 50 has a configuration which is circular or cylindrical such that uniform irradiance is insured to all points on the cylindrical surface from the flash lamp positioned along the central axis thereof. In this manner, the cylindrical configuration of a small diameter can be used then would be necessary to fuse the images onto a support sheet in piece meal fashion by energizing the lamp a number of times as different portions of the toner bearing sheet are transported past the flash lamp.

Flash lamp 52 is energized by a sensing member 60 which is positioned to sense the leading edge of the sheet S before completing the circular path defined by cylindrical elements 55. Alternatively the lamp can be energized by a timing circuit as is known by those skilled in the art. It has been found that a xenon flash lamp operating at power levels between 600 and 1200 Joules produces very good toner fusion. Pulse durations between 0.25 and 1.5 milliseconds were found to provide acceptable fusing with pulses between 0.5 and 1.2 milliseconds giving better fusing results. It has also been found that longer pulses of energy are required as the power level increases. Power input to the flash lamp 50 is provided by any suitable power supply such as a DC source with an adjustable voltage.

It will be appreciated that the energy described would be the power input to the flash fusing lamp itself and not the energy that actually strikes the paper. The energy to fuse toner in this case would be about 3.5 Joules/in$^2$ incident on the paper. Thus for a 9 × 12 inch area this would be 378 Joules. In other words, the lamp is typically about 60% to 70% efficient bringing the power to 600 Joules. Therefore, 600 Joules normally has to be supplied to the lamp.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit and scope of the invention.

What is claimed is:

1. An improved flash fusing apparatus for fusing toner images onto a copy sheet comprising:

an elongated flash lamp, a cylindrically shaped member circling said flash lamp along the longitudinal axis thereof, and means for positioning a copy sheet bearing toner images along the cylindrical member to form a circular path around said flash lamp whereupon energizing said lamp uniform direct radiation is imparted to the sheet to fuse the toner particles at a reduced power output.

2. Apparatus according to claim 1 including sensing means for detecting the lead edge of sheet to provide a signal to energize the flash lamp.

3. Apparatus according to claim 1 wherein at least one disc member is positioned along the path of the sheet to impart movement thereto.

4. Apparatus according to claim 1 wherein the length of the circular path is substantially the length of the copy sheet.

* * * * *